US011590772B2

(12) United States Patent
Numata

(10) Patent No.: US 11,590,772 B2
(45) Date of Patent: Feb. 28, 2023

(54) HEATING DEVICE, DRYING DEVICE, AND LIQUID DISCHARGE APPARATUS

(71) Applicant: Hironori Numata, Ibaraki (JP)

(72) Inventor: Hironori Numata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/989,775

(22) Filed: Aug. 10, 2020

(65) Prior Publication Data

US 2021/0053370 A1 Feb. 25, 2021

(30) Foreign Application Priority Data

Aug. 21, 2019 (JP) ..... JP2019-151320
Jun. 24, 2020 (JP) ..... JP2020-108803

(51) Int. Cl.
*B41J 2/01* (2006.01)
*B41J 11/00* (2006.01)

(52) U.S. Cl.
CPC ..... *B41J 11/002* (2013.01); *B41J 11/0085* (2013.01)

(58) Field of Classification Search
None
See application file for complete search history.

(56) References Cited

U.S. PATENT DOCUMENTS 6,161,930 A * 12/2000 Asano ..... B41J 2/17593 347/102
2012/0098881 A1 4/2012 Numata
2015/0015636 A1 1/2015 Kuwana et al.
2015/0022600 A1 1/2015 Numata
2017/0217211 A1 8/2017 Nakano
2017/0266987 A1 9/2017 Asada et al.
2017/0334217 A1* 11/2017 Yoshinuma ..... B41J 11/00216
2018/0264803 A1 9/2018 Hoshino et al.
2018/0264852 A1* 9/2018 Ohtake ..... B65H 37/00
2019/0070870 A1* 3/2019 Janssen ..... B41J 13/0027
2019/0193426 A1* 6/2019 Mizushima ..... B41J 13/02

FOREIGN PATENT DOCUMENTS

EP 2407310 A2 1/2012
JP 09300449 A * 11/1997
JP 2004133488 A * 4/2004
JP 2018-154500 10/2018

OTHER PUBLICATIONS

European Search Report; Application EP20190237; dated Jan. 14, 2021.

* cited by examiner

*Primary Examiner* — Erica S Lin
*Assistant Examiner* — Tracey M McMillion
(74) *Attorney, Agent, or Firm* — Duft & Bornsen, PC

(57) ABSTRACT

A heating device heats a sheet to which a liquid discharge unit discharges a liquid. The heating device includes a first heater to heat the sheet that has passed through the liquid discharge unit, a vacuum conveyor to convey the sheet that has passed through the first heater while sucking the sheet, a second heater to heat the sheet being conveyed by the vacuum conveyor, and circuitry that cause the first heater to heat the sheet when sheet data regarding the sheet satisfies a predetermined condition.

12 Claims, 17 Drawing Sheets

| TYPE OF SHEET | BASIS WEIGHT (THICKNESS) | FIRST DRYER | SECOND DRYER |
|---|---|---|---|
| COATED PAPER | LOW (THIN) | ON | ON |
| | HIGH (THICK) | OFF | ON |
| PLAIN PAPER | – | OFF | ON |

| TREATMENT LIQUID | TYPE OF SHEET | BASIS WEIGHT (THICKNESS) | FIRST DRYER | SECOND DRYER |
|---|---|---|---|---|
| APPLICATION | COATED PAPER | LOW (THIN) | OFF | ON |
| | | HIGH (THICK) | OFF | ON |
| | PLAIN PAPER | – | OFF | ON |
| NO APPLI-CATION | COATED PAPER | LOW (THIN) | ON | ON |
| | | HIGH (THICK) | OFF | ON |
| | PLAIN PAPER | – | OFF | ON |

FIG. 17

| TYPE OF SHEET | BASIS WEIGHT (THICKNESS) | TREATMENT LIQUID | | FIRST DRYER | SECOND DRYER |
|---|---|---|---|---|---|
| COATED PAPER | LOW (THIN) | NO APPLICATION | | ON (HIGH DUTY) | ON |
| | | APPLI-CATION | VERY SMALL AMOUNT | ON (MEDIUM DUTY) | ON |
| | | | SMALL AMOUNT | ON (LOW DUTY) | ON |
| | | | NORMAL AMOUNT | OFF | ON |
| | | | LARGE AMOUNT | OFF | ON |
| | HIGH (THICK) | NO APPLICATION | | OFF | ON |
| | | APPLI-CATION | VERY SMALL AMOUNT | OFF | ON |
| | | | SMALL AMOUNT | OFF | ON |
| | | | NORMAL AMOUNT | OFF | ON |
| | | | LARGE AMOUNT | OFF | ON |
| PLAIN PAPER | LOW (THIN) | APPLICATION | | OFF | ON |
| | | NO APPLICATION | | OFF | ON |

HEATING DEVICE, DRYING DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-151320, filed on Aug. 21, 2019 and 2020-108803, filed on Jun. 24, 2020, in the Japan Patent Office, the entire disclosure of each of which is hereby incorporated by reference herein.

BACKGROUND

Technical Field

The present disclosure relates to a heating device, a drying device, and a liquid discharge apparatus.

Description of the Related Art

A certain liquid discharge apparatus includes a drying device including a heater that heats a sheet to which a liquid is applied.

SUMMARY

Embodiments of the present disclosure describe an improved heating device that heats a sheet to which a liquid discharge unit discharges a liquid. The heating device includes a first heater to heat the sheet that has passed through the liquid discharge unit, a vacuum conveyor to convey the sheet that has passed through the first heater while sucking the sheet, a second heater to heat the sheet being conveyed by the vacuum conveyor, and circuitry that cause the first heater to heat the sheet when sheet data regarding the sheet satisfies a predetermined condition.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 17 is a table stored in the memory according to a sixth embodiment of the present disclosure;

Figure 1:
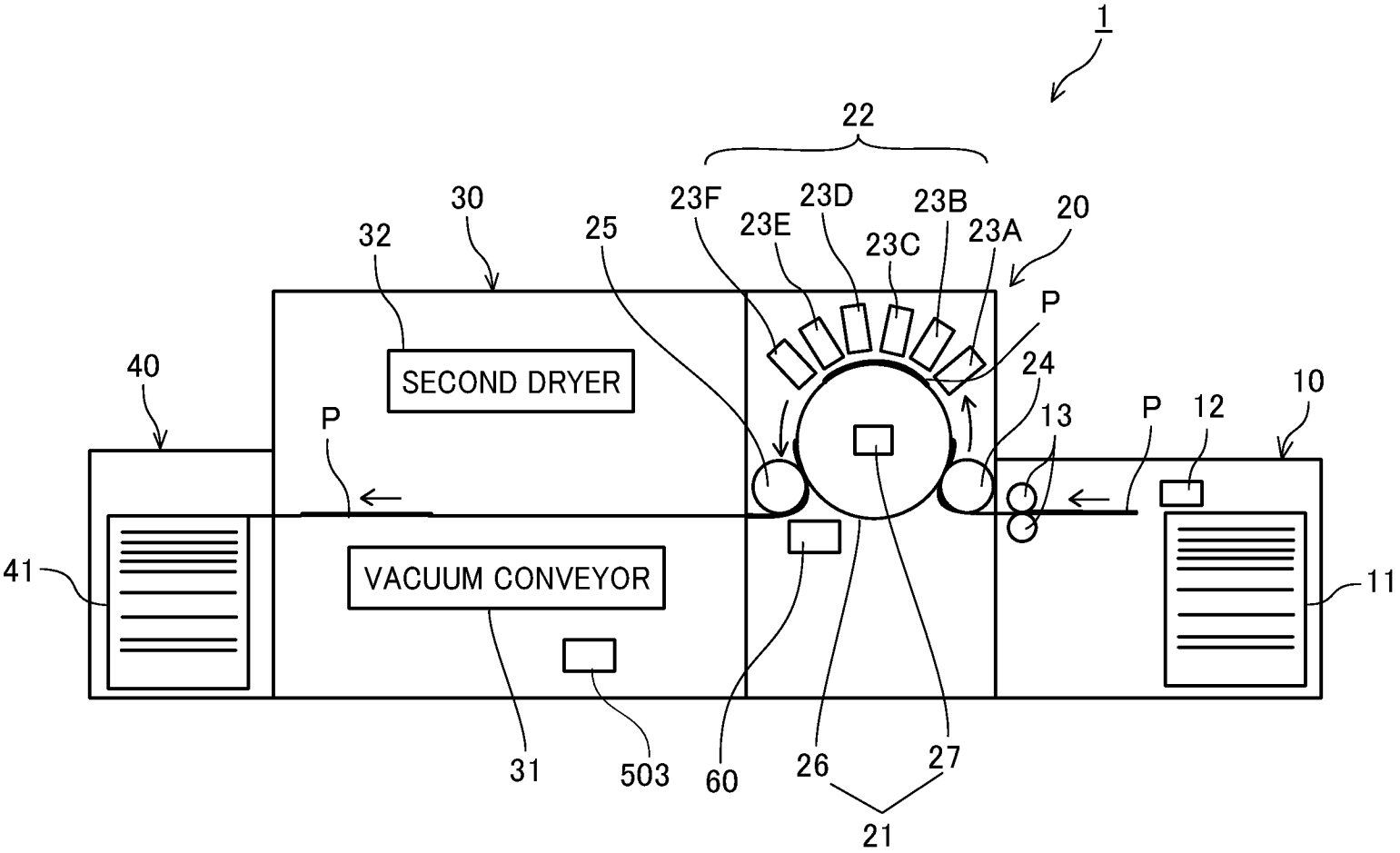
FIG. 1 is a schematic view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

There is a certain drying device that heats a sheet while a vacuum conveyance belt conveys the sheet to dry the sheet. When the sheet is heated while being conveyed by the vacuum conveyance belt having a suction hole, the temperature becomes relatively high in the portion without the suction hole, and the temperature does not relatively rise in the portion of the suction hole, resulting in temperature unevenness. The temperature unevenness of the vacuum conveyance belt may cause image unevenness such as color unevenness of images on the sheet due to the liquid applied to the sheet.

The present disclosure has been made in view of the above, and an object of the present disclosure is to reduce power consumption while preventing abnormal images.

Embodiments of the present disclosure are described below with reference to the accompanying drawings.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

Figure 2:
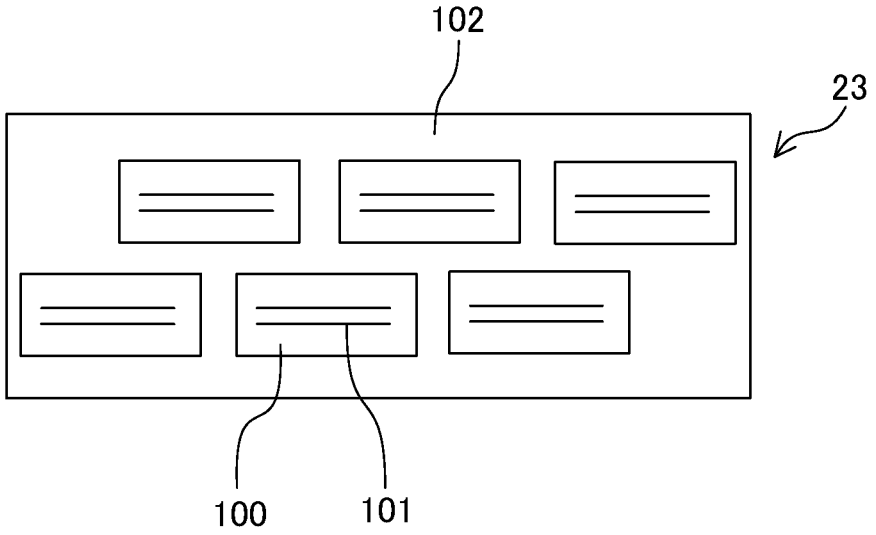
FIG. 2 is a plan view of an example of a discharge unit of the printer illustrated in FIG. 1.

A first embodiment of the present disclosure is described with reference to FIGS. 1 and 2. FIG. 1 is a schematic view of a printer 1 as a liquid discharge apparatus according to the first embodiment. FIG. 2 is a plan view of an example of a discharge unit 23 of the printer 1 illustrated in FIG. 1.

The printer 1 includes a loading device 10, a printing device 20, a drying device 30, and an ejection device 40. In the printer 1, the printing device 20 applies a liquid to a sheet P carried from the loading device 10, thereby performing printing, and the drying device 30 dries the liquid adhering to the sheet P, after which the sheet P is ejected to the ejection device 40.

The loading device 10 includes a loading tray 11 on which a plurality of sheets P are stacked, a feeder 12 to separate and feed the sheets P one by one from the loading tray 11, and a registration roller pair 13 to feed the sheets P to the printing device 20. Any feeder such as a device using a roller or a device using air suction may be used as the feeder 12. The sheet P fed from the loading tray 11 by the feeder 12 is delivered to the printing device 20 by the registration roller pair 13 being driven at a predetermined timing after a leading end of the sheet P reaches the registration roller pair 13.

The printing device 20 includes a sheet conveyor 21 to convey the sheet P. The sheet conveyor 21 includes a drum 26 and a suction unit 27. The drum 26 bears the sheet P on a circumferential surface thereof and rotates. The suction unit 27 generates a suction force on the circumferential surface of the drum 26. The printing device 20 further includes a liquid discharge section 22 that discharges a liquid toward the sheet P carried on the drum 26 of the sheet conveyor 21. The printing device 20 further includes a transfer cylinder 24 that receives the sheet P delivered from the loading device 10 and transfers the sheet P to the drum 26 and a transfer cylinder 25 that transfers the sheet P conveyed by the drum 26 to the drying device 30.

The transfer cylinder 24 includes a gripper to grip the leading end of the sheet P conveyed from the loading device 10 to the printing device 20. The sheet P thus gripped is conveyed as the transfer cylinder 24 rotates. The transfer cylinder 24 transfers the sheet P to the drum 26 at a position opposite the drum 26. Similarly to the transfer cylinder 24, the drum 26 includes a gripper on the surface thereof, and the leading end of the sheet P is gripped by the gripper. A plurality of suction holes is dispersedly formed on the surface of the drum 26. A suction unit 27 generates a suction airflow through the plurality of suction holes of the drum 26 toward an interior of the drum 26. On the drum 26, the gripper grips the leading end of the sheet P transferred from the transfer cylinder 24, and the sheet P is attracted to and carried on the drum 26 by the suction airflow by the suction unit 27. As the drum 26 rotates, the sheet P is conveyed.

The liquid discharge section 22 includes discharge units 23 (23A to 23F) as liquid discharge units. For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively. Further, the discharge units 23E and 23F are used to discharge the liquid of any one of Y, M, C, and K or a liquid of spot color such as white, gold, or silver. Furthermore, a discharge unit that discharges a treatment liquid such as a surface coating liquid may be provided.

The discharge unit 23 is a full line head and includes a plurality of liquid discharge heads 100 arranged on a base 102. The liquid discharge head 100 includes nozzle rows 101 including a plurality of nozzles. The nozzles are arranged, for example, as illustrated in FIG. 2. The discharge operation of each discharge unit 23 of the liquid discharge section 22 is controlled by a drive signal corresponding to print data. When the sheet P carried by the drum 26 passes through a region facing the liquid discharge section 22, the liquid of each color is discharged from the discharge units 23, and an image corresponding to the print data is printed on the sheet P.

The drum 26 forwards the sheet P to which a liquid is applied by the liquid discharge section 22 to the transfer cylinder 25 as a transfer rotator. Similarly to the drum 26, the transfer cylinder 25 includes a gripper 82 (see FIG. 3) on the surface thereof. After released from the gripper of the drum 26, the leading end of the sheet P is gripped by the gripper 82 of the transfer cylinder 25, thereby transferring the sheet P from the drum 26 to the transfer cylinder 25. While rotating, the transfer cylinder 25 conveys the sheet P on the circumferential surface (i.e., a transfer path) thereof and transfer the sheet P to a vacuum conveyor 31 of the drying device 30.

The drying device 30 includes a first dryer 60 as a first heater disposed between the printing device 20 and a housing of the drying device 30 to dry the sheet P on the transfer path of the transfer cylinder 25. The first dryer 60 heats the sheet P to dry the liquid that adheres to the sheet P in the printing device 20. The drying device 30 further includes the vacuum conveyor 31 and a second dryer 32 as a second heater. The vacuum conveyor 31 conveys the sheet P transferred from the transfer cylinder 25 of the printing device 20 while sucking the sheet P. The second dryer 32 blows hot air onto the sheet P being conveyed by the vacuum conveyor 31 to dry the liquid on the sheet P.

After the printing device 20 applies the liquid to the sheet P, the first dryer 60 dries the sheet P when the transfer cylinder 25 transfers the sheet P to the vacuum conveyor 31. In addition, the second dryer 32 heats and dries the sheet P being conveyed by the vacuum conveyor 31. Then, the vacuum conveyor 31 transfers the sheet P to the ejection device 40. That is, the liquid on the sheet P is subjected to a pre-drying process by the first dryer 60, after which the liquid is further subjected to a main drying process when the sheet P passes through the second dryer 32.

In this embodiment, the first dryer 60 as the first heater and the second dryer 32 as the second heater constitute the drying device (heating device) 30 according to the present disclosure. With this configuration, a liquid component such as moisture in the liquid evaporates, and the colorant contained in the liquid is reliably fixed on the sheet P. Additionally, curling of the sheet P is restrained.

The ejection device 40 includes an ejection tray 41 on which a plurality of sheets P is stacked. The plurality of sheets P conveyed from the drying device 30 is sequentially stacked and held on the ejection tray 41.

Although the printer 1 to perform printing on cut sheets P is described as the liquid discharge apparatus, embodiments of the present disclosure are applicable to a printer or the like to perform printing on a continuous medium, such as continuous paper.

A description is given of ink as the liquid used in the printer 1. In the present embodiment, the ink is aqueous ink that contains an organic solvent, water, a colorant, resin, an additive, etc.

[Ink]

Compositional materials of the ink (e.g., organic solvent, water, colorant, resin, and additives) are described in detail below.

[Organic Solvent]

There is no specific limitation on the type of the organic solvent used in the present disclosure. For example, water-soluble organic solvents are usable. Examples thereof include, but are not limited to, polyols, ethers such as polyol alkyl ethers and polyol aryl ethers, nitrogen-containing heterocyclic compounds, amides, amines, and sulfur-containing compounds. In particular, organic solvents having a boiling point of 250° C. or less are preferable, since the organic solvents can function as a wetting agent while providing good drying property. The proportion of the organic solvent in the ink is not particularly limited and can be appropriately selected to suit to a particular application, but is preferably from 10% to 60% by mass, more preferably from 20% to 60% by mass, for drying property and discharge reliability of the ink.

[Water]

The proportion of water in the ink is not particularly limited and can be appropriately selected to suit to a particular application, but is preferably from 10% to 90% by mass, more preferably from 20% to 60% by mass, for drying property and discharge reliability of the ink.

[Colorant]

The colorant is not particularly limited, and pigments and dyes can be used. Usable pigments include both inorganic pigments and organic pigments. One type of pigment can be used alone, or two or more types of pigments can be used in combination. A mixed crystal may be used as the pigment. The proportion of the colorant in the ink is preferably from 0.1% to 15% by mass, more preferably from 1% to 10% by mass, for improving image density, fixability, and discharge stability. Usable pigments include, but are not limited to, black pigments, yellow pigments, magenta pigments, cyan pigments, white pigments, green pigments, orange pigments, glossy color pigments (e.g., gold pigments and silver pigments), and metallic pigments.

[Resin]

The type of the resin contained in the ink is not particularly limited and can be suitably selected to suit to a particular application. Specific examples thereof include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins. The proportion of the resin is not particularly limited and can be suitably selected to suit to a particular application. Preferably, the proportion of the resin in the ink is from 1% to 30% by mass, more preferably from 5% to 20% by mass, for fixability and storage stability of the ink.

[Additives]

The ink may further contain a surfactant, a defoamer, a preservative, a fungicide, a corrosion inhibitor, and/or a pH adjuster.

Figure 3:
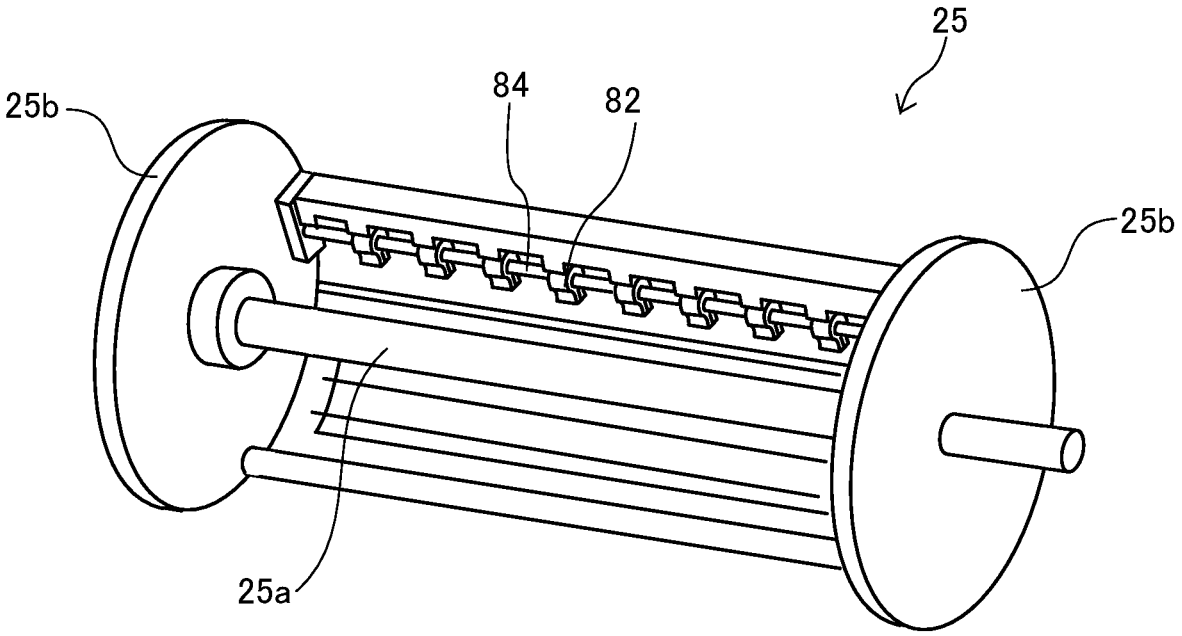
FIG. 3 is a perspective view of an example of a transfer cylinder of the printer illustrated in FIG. 1.

Next, a description is given below of an example of the transfer cylinder 25 as the transfer rotator with reference to FIG. 3. FIG. 3 is a perspective view of the transfer cylinder 25. The transfer cylinder 25 includes a rotation shaft 25*a*, flanges 25*b* attached to both ends of the rotation shaft 25*a*, a holder 84 that bridges between the flanges 25*b*, and the gripper 82 having a plurality of grippers held by the holder 84. As illustrated in FIG. 3, in the transfer cylinder 25, portions other than the rotation shaft 25*a*, the gripper 82, and the holder 84 are substantially hollow in the width direction of the sheet P. Therefore, hot air and radiant heat can penetrate the transfer cylinder 25 in the direction perpendicular to the axial direction of the transfer cylinder 25.

Figure 4:
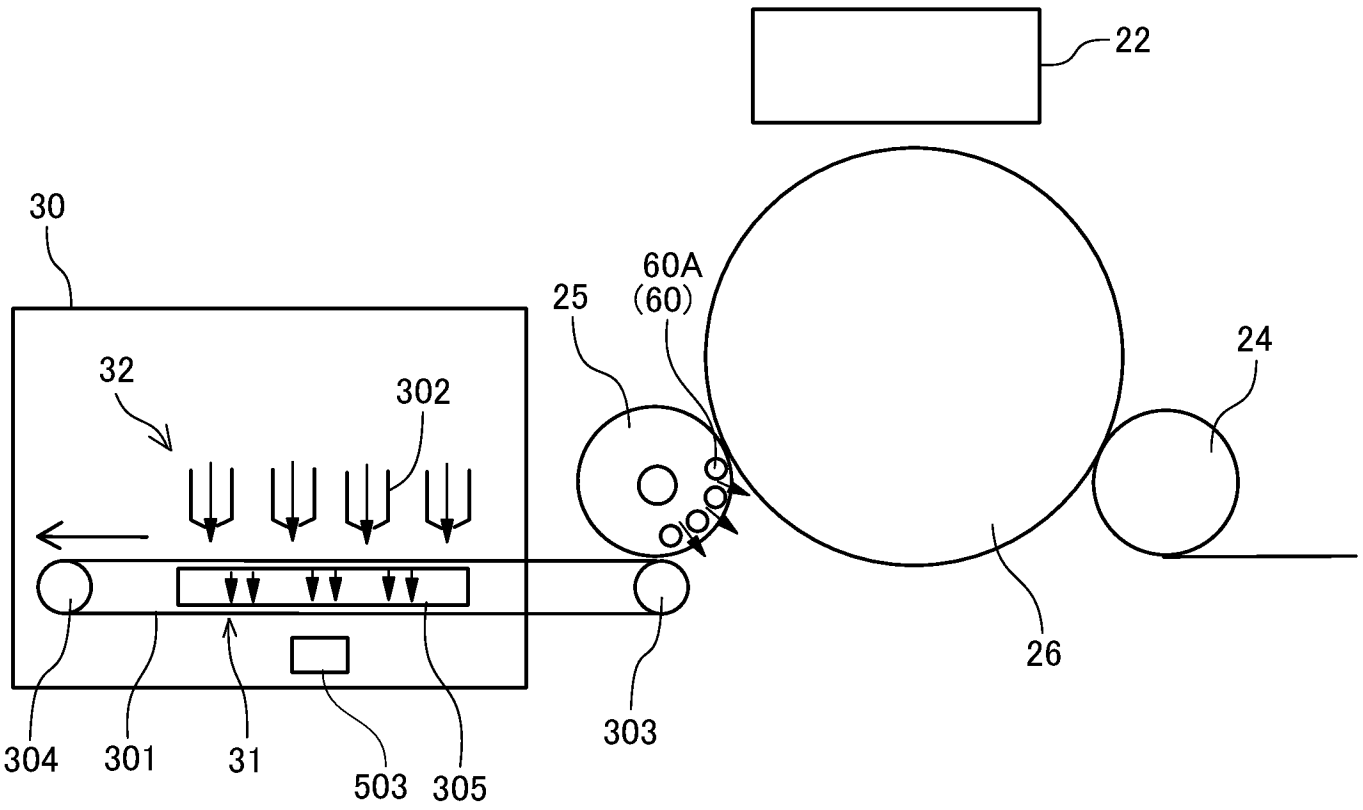
FIG. 4 is a partial view of the printer to illustrate a first dryer (first heater) and a second dryer (second heater) according to the first embodiment.

Next, a description is given of the first dryer (first heater) 60 and the second dryer (second heater) 32 according to the first embodiment with reference to FIG. 4. FIG. 4 is a partial view of the printer (liquid discharge apparatus) 1 to illustrate the first dryer 60 and the second dryer 32. In the present embodiment, an infrared heater (IR heater) 60A serving as the first dryer 60 is disposed inside the transfer cylinder 25. The vacuum conveyor 31 of the drying device 30 includes a vacuum conveyance belt 301 to suck and convey the sheet P. The transfer cylinder 25 transfers the sheet P from the drum 26 to the vacuum conveyance belt 301. The vacuum conveyance belt 301 is wound around a drive roller 303 and a driven roller 304, and is rotated by driving the drive roller 303. The second dryer 32 of the drying device 30 includes a hot air blower 302 to blow hot air onto the sheet P being conveyed by the vacuum conveyance belt 301 to dry the liquid on the sheet P. The second dryer 32 is not limited to the hot air blower 302, and a radiant heater such as an IR heater can be used.

Figure 5:
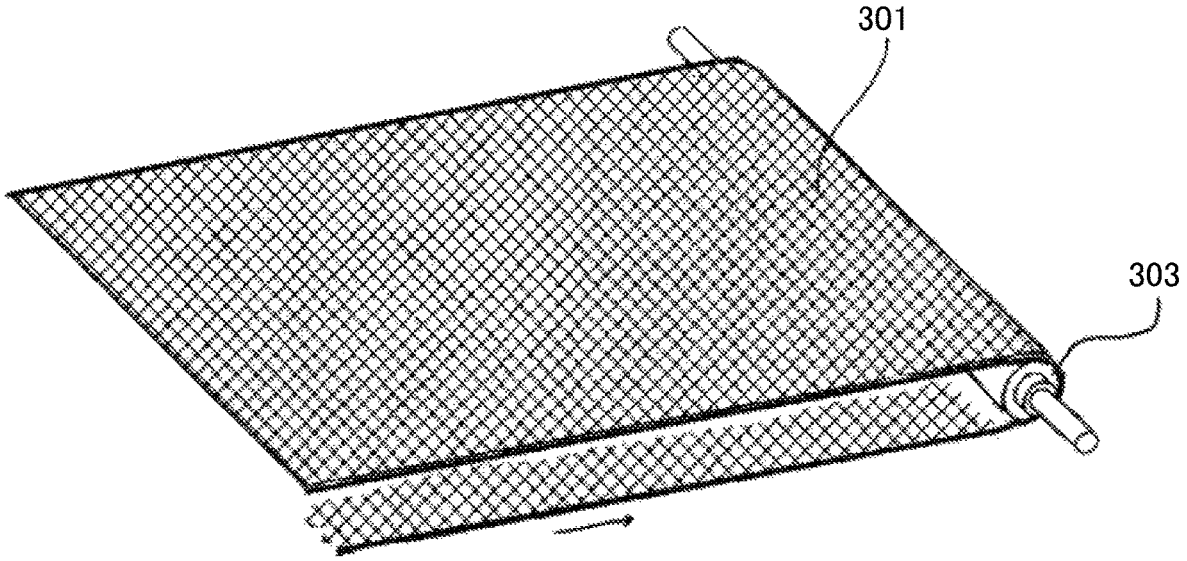
FIG. 5 is a perspective view of an example of a vacuum conveyance belt according to embodiments of the present disclosure.
Figure 6:
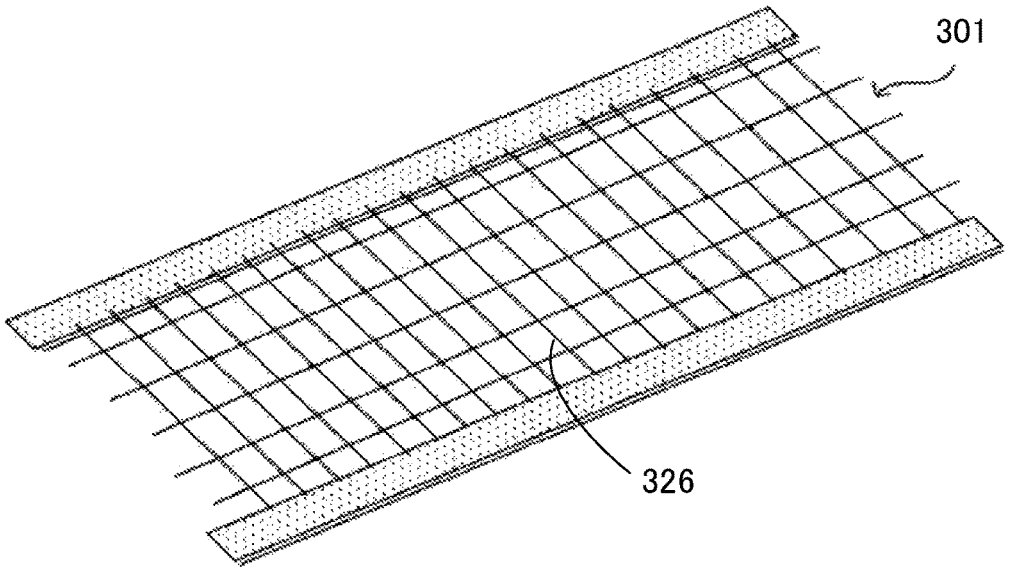
FIG. 6 is a perspective view of another example of the vacuum conveyance belt according to embodiments of the present disclosure.

Different examples of the vacuum conveyance belt 301 are described with reference to FIGS. 5 and 6. FIG. 5 is a perspective view of a first example of the vacuum conveyance belt 301, and FIG. 6 is a perspective view of a second example of the vacuum conveyance belt 301. The vacuum conveyance belt 301 has an air-permeable structure, for example, in which a plurality of through holes (suction holes) are dispersed and opened on the surface thereof. A suction fan serving as a suction mechanism 305 is disposed inside the vacuum conveyance belt 301, and the sheet P is attracted to the vacuum conveyance belt 301 by the operation of the suction fan. For example, a mesh belt made of glass fiber can be used as the vacuum conveyance belt 301. In the mesh belt, for example, the linear materials are arranged in a mesh as illustrated in the first example in FIG. 5. With the mesh belt, the sheet P is prevented from fluttering due to the rebound of the hot air blown from the hot air blower 302.

Alternatively, the vacuum conveyance belt 301 may have any structure in which suction holes are formed on the surface thereof, for example, a structure in which the sheet P is supported by a plurality of support wires 326 as illustrated in the second example in FIG. 6 or a structure made of a porous material. Further, the suction holes are not limited to the rectangular shape as illustrated in FIGS. 5 and 6, and may have a circular shape or a honeycomb shape.

The amount of heat given to the sheet P by the hot air blower 302 of the second dryer 32 is larger than the amount of heat given to the sheet P by the IR heater 60A of the first dryer 60. As described above, the IR heater 60A as the first dryer 60 dries the sheet P on the transfer path where the transfer cylinder 25 transfers the sheet P from the drum 26 to the vacuum conveyance belt 301 of the vacuum conveyor 31. Then, the hot air blower 302 of the second dryer 32 blows hot air onto the sheet P dried by the IR heater 60A, thereby further drying the sheet P. As a result, the liquid applied to the sheet P can be reliably dried, and the drying performance is improved.

That is, the first dryer 60 dries the sheet P early before the drying process by the second dryer 32, thereby preventing drying unevenness, uneven gloss, and image unevenness due to the movement of the pigment on the printing surface (the surface of the sheet P to which the liquid is applied). In this state, the second dryer 32 dries the sheet P. Therefore, the liquid is reliably fixed on the sheet P and prevented from peeling off the printing surface. The first dryer 60 is not limited to the IR heater described above. For example, a hot air blower can be disposed opposite the transfer path of the transfer cylinder 25 so as to blow hot air from the back side of the transfer cylinder 25 to the surface of the sheet P to which the liquid has been applied.

Since the vacuum conveyance belt 301 faces the hot air blower 302 of the second dryer 32, the temperature of the surface of the vacuum conveyance belt 301, which contacts the sheet P, is raised by the hot air blower 302. However, the temperature of suction holes does not rise higher than the temperature of the surface of the vacuum conveyance belt 301 because the suction holes of the vacuum conveyance belt 301 are empty space.

Therefore, if the sheet P is placed on the surface of the vacuum conveyance belt 301 in a state in which the water-based liquid (aqueous ink) is not sufficiently dried, the temperature difference between the surface of the vacuum conveyance belt 301 and the suction holes causes the pigment in the ink on the sheet P to flow. As a result, for example, a pattern (color unevenness) corresponding to the mesh shape of the mesh belt appears in the image. In particular, color unevenness is likely to occur on a coated paper having a thin thickness or low basis weight of the sheet P. The coated paper is a sheet, the surface of which is coated with a paint to enhance smoothness.

Therefore, in the present embodiment, the pre-drying process by the first dryer 60 is performed before the main drying process on the vacuum conveyance belt 301 by the second dryer 32, thereby preventing the ink from flowing. This configuration can prevent abnormal images in which the pattern corresponding to the mesh shape of the mesh belt appears. In other words, when a water-based liquid (aqueous ink) is applied to the sheet P and dried while the sheet P is conveyed by the mesh belt, the pre-drying process before placing the sheet P on the mesh belt prevents the abnormal images from occurring.

In the present embodiment, the ink containing at least water as a liquid is dried by the first dryer 60 and the second dryer 32. The first dryer 60 dries the ink to prevent the ink flow due to heating unevenness between the surface of the vacuum conveyance belt 301 and the suction holes. The second dryer 32 dries the ink to prevent the ink from being rubbed when the sheets P are stacked in the ejection device 40.

The ink flow is likely to occur on the coated paper having a thin thickness or low basis weight of the sheet P. In the case of a thick coated paper, the heating unevenness due to the vacuum conveyance belt 301 is uniformed in the layer of the sheet P before the heat from the vacuum conveyance belt 301 reaches the ink. As a result, color unevenness does not occur. Further, in the case of a plain paper whose surface is not coated, the pigment permeates the layer of the sheet P before flowing, so that color unevenness due to the heating unevenness does not occur.

Accordingly, in the case of the sheet P in which the color unevenness due to the influence of the heating unevenness does not occur, the pre-drying process is unnecessary, and thus preferably, the pre-drying process by the first dryer 60 is not performed to reduce the power consumption. Therefore, in the present embodiment, whether the drying process by the first dryer 60 is performed or not is controlled according to the type of the sheet P.

Figures 7, 8:
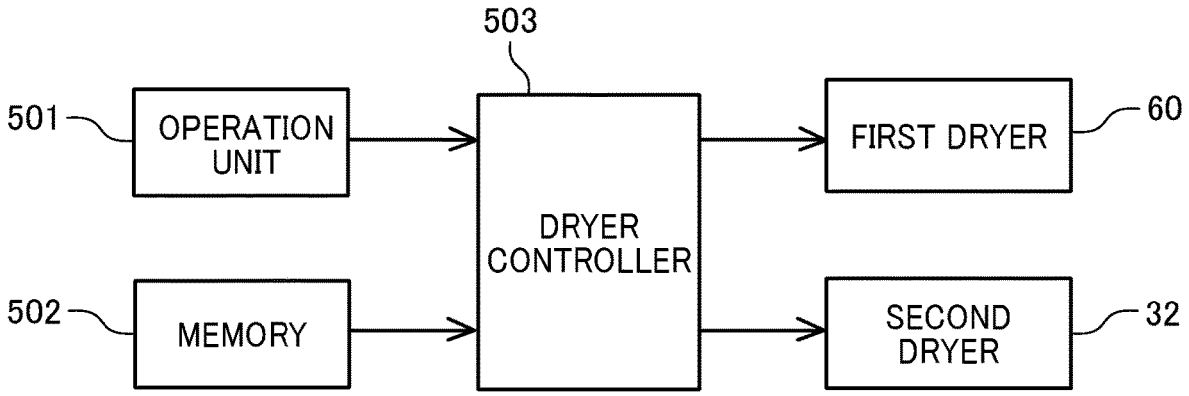
FIG. 7 is a block diagram of a portion related to control of a drying operation by the first dryer and the second dryer according to the first embodiment.
FIG. 8 is a table stored in a memory illustrated in FIG. 7.

Next, control of the drying operation by the first dryer 60 and the second dryer 32 is described below with reference to FIGS. 7 and 8. FIG. 7 is a block diagram of the control system of the printer (liquid discharge apparatus) 1. FIG. 8 is a table stored in a memory 502 illustrated in FIG. 7.

An operator can input the type of the sheet P, using an operation unit 501. That is, the operator sets, for example, coated paper, plain paper, or the like as the sheet P, which is sheet data regarding the sheet P. Further, when coated paper is set as the type of the sheet P, the operator can input data on the basis weight or the thickness of the sheet P, using the operation unit 501. The data on the basis weight or the thickness of the sheet P is the sheet data regarding the sheet P. The operation unit 501 is, for example, an operation panel provided in the printer 1 or a print instruction terminal (e.g., a computer) connected to the printer 1.

The memory 502 stores a table as illustrated in FIG. 8 in which the sheet data, such as the data on the type of the sheet P and the data on the basis weight or thickness of the sheet P, and ON/OFF data of the first dryer 60 and the second dryer 32 are tabulated.

A dryer controller 503 as circuitry reads the table, which includes the data on the type, and the basis weight or thickness of the sheet P input from the operation unit 501, from the memory 502. Base on the table, the dryer controller 503 turns on and off the first dryer 60 and the second dryer 32. The dryer controller 503 turns on the first dryer 60 to dry (heat) the sheet P by the first dryer 60 when the sheet data satisfies a predetermined condition, that is, when the sheet P is coated paper and the basis weight is low (the thickness is thin). The dryer controller 503 turns on the second dryer 32 regardless of the type, basis weight or thickness of the sheet P during printing.

Figure 9:
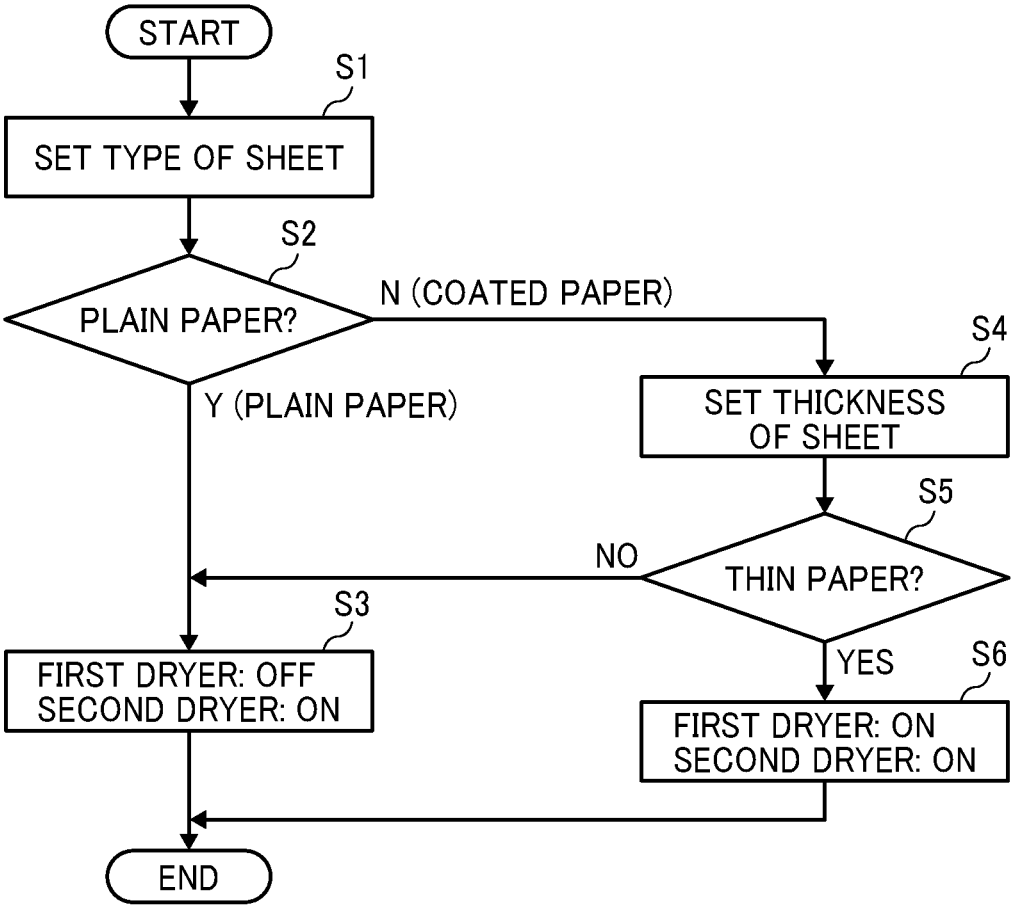
FIG. 9 is a flowchart illustrating the control of the drying operation by a dryer controller according to the first embodiment.

Next, a description is given of control of the drying operation by the dryer controller 503 according to the first embodiment, with reference to a flowchart in FIG. 9. First, the operator sets the type of the sheet P by the operation unit 501 in step S1. Hereinafter, step S1 (and other steps) is simply referred to as "S1". Then, the dryer controller 503 determines whether the type of the sheet P is plain paper or not (S2).

When the type of the sheet P is plain paper, the predetermined condition that the sheet P is coated paper is not satisfied. Accordingly, the dryer controller 503 turns off the first dryer 60 not to dry the sheet P and turn on the second dryer 32 to dry the sheet P (S3). On the other hand, when the sheet P is not plain paper, that is, when the sheet P is coated paper, in the present embodiment, the operator set the thickness (or basis weight) of the sheet P by the operation unit 501 (S4).

Then, the dryer controller 503 checks whether the thickness (or basis weight) of the sheet P is equal to or less than a threshold value, and determines whether or not the sheet P is thin paper having a thickness equal to or less than the threshold value (S5). When the sheet P is thin paper, the predetermined condition that the sheet P is coated paper and thin paper is satisfied. Accordingly, the dryer controller 503 turns on the first dryer 60 to dry the sheet P and turns on the second dryer 32 to dry the sheet P (S6).

On the other hand, when the sheet P is not thin paper, the predetermined condition that the sheet P is coated paper and thin paper is not satisfied. Accordingly, the process proceeds to step S3, and the dryer controller 503 turns off the first dryer 60 not to dry the sheet P and turns on the second dryer 32 to dry the sheet P.

As described above, when the sheet P, such as plain paper or thick coated paper, does not cause color unevenness due to the influence of the heating unevenness between the presence and absence of the suction holes on the vacuum conveyance belt 301, the dryer controller 503 turns off the first dryer 60 not to dry the sheet P, thereby reducing the power consumption of the printer (liquid discharge apparatus) 1.

On the other hand, when the sheet P, such as thin coated paper, causes color unevenness due to the influence of the heating unevenness between the presence and absence of the suction holes on the vacuum conveyance belt 301, the dryer controller 503 turns on the first dryer 60 to dry the sheet P, thereby preventing color unevenness from occurring. As a result, abnormal images are prevented.

In the table in FIG. 8, when the basis weight exceeds, for example, 150 grams per square meter (gsm), the sheet P is defined as thick paper having a high basis weight. Usually, the sheet P is controlled by the basis weight, but alternatively, the sheet P having a thickness that exceeds 0.17 mm as a reference may be defined as thick paper. Therefore, the basis weight of 150 gsm or the thickness of 0.17 mm is the threshold value, and the sheet P having the basis weight equal to 150 gsm or less, or the thickness equal to 0.17 mm or less is defined as thin paper. However, the threshold value is not limited to the above-described example.

Figure 10:
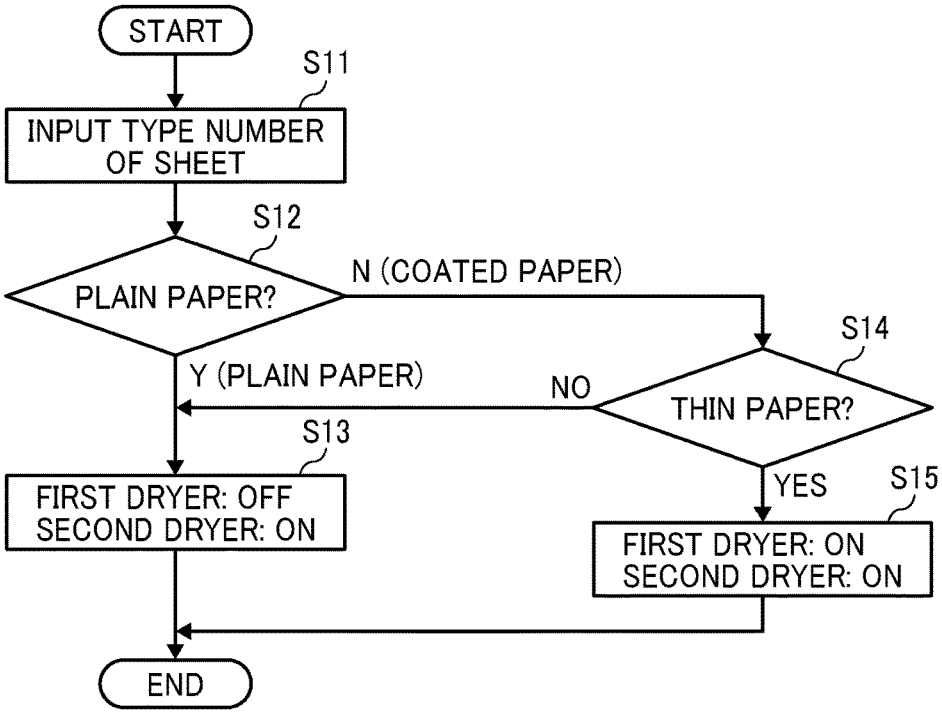
FIG. 10 is a flowchart illustrating the control of the drying operation according to a second embodiment of the present disclosure.

Next, a second embodiment of the present disclosure is described with reference to FIG. 10. FIG. 10 is a flowchart illustrating control of the drying operation according to the second embodiment. In the present embodiment, an operator inputs a type number of the sheet P, using the operation unit 501. The memory 502 also stores a table in which the type number of the sheet P is associated with the type of the sheet P (e.g., coated paper and plain paper) and basis weight (or thickness).

As the operator inputs the type number of the sheet P by the operation unit 501 (S11), the dryer controller 503 refers to the table stored in the memory 502 and determines whether the sheet P corresponding to the type number is plain paper or not (S12). When the type of the sheet P is plain paper, the predetermined condition that the sheet P is coated paper is not satisfied. Accordingly, the dryer controller 503 turns off the first dryer 60 not to dry the sheet P and turns on the second dryer 32 to dry the sheet P (S13).

On the other hand, when the sheet P is not plain paper, that is, when the sheet P is coated paper, the dryer controller 503 checks whether the thickness (or basis weight) of the sheet P is equal to or less than the threshold value, and determines whether or not the sheet P is thin paper having a thickness equal to or less than the threshold value (S14). When the sheet P is thin paper, the predetermined condition that the sheet P is coated paper and thin paper is satisfied. Accordingly, the dryer controller 503 turns on the first dryer 60 to dry the sheet P and turns on the second dryer 32 to dry the sheet P (S15).

On the other hand, when the sheet P is not thin paper, the predetermined condition that the sheet P is coated paper and thin paper is not satisfied. Accordingly, the process proceeds to step S13, and the dryer controller 503 turns off the first dryer 60 not to dry the sheet P and turns on the second dryer 32 to dry the sheet P. Such a configuration facilitates an operator inputting the sheet data and enhances the operability of the operation unit 501.

Figure 11:
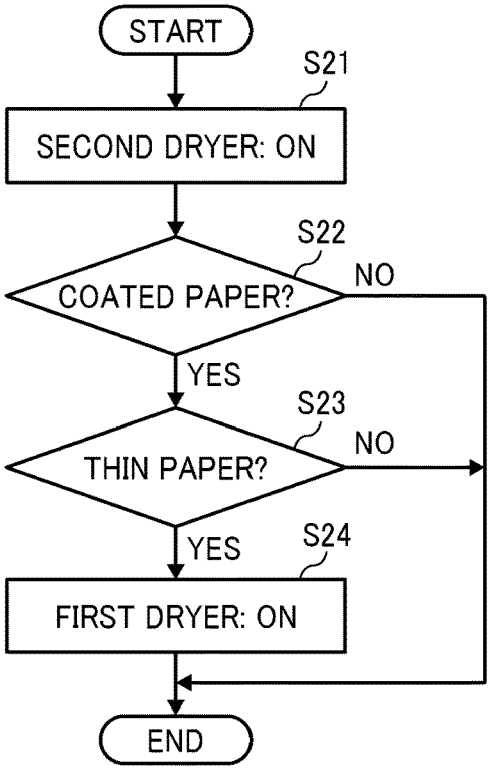
FIG. 11 is a flowchart illustrating the control of the drying operation according to a third embodiment of the present disclosure.

Next, a third embodiment of the present disclosure is described with reference to FIG. 11. FIG. 11 is a flowchart illustrating control of the drying operation according to the third embodiment. In the present embodiment, the table is not provided in the memory 502 described in the first embodiment. The sheet data regarding the sheet P, such as the type and basis weight (or thickness) of the sheet P input from the operation unit 501, is temporarily stored in a buffer or the like. Then, the dryer controller 503 turns on the second dryer 32 to dry (heat) the sheet P (S21). That is, as described in the first and second embodiments, the second dryer 32 is turned on regardless of the sheet data. Therefore, in the present embodiment, turning on and off the second dryer 32 is not associated with the sheet data regarding the sheet P.

Next, the dryer controller 503 determines whether the type of the sheet P input from the operation unit 501 is coated paper or not (S22). If the type of the sheet P is not coated paper, that is, if the sheet P is plain paper, the predetermined condition is not satisfied, and therefore the process is ended. As a result, the first dryer 60 is not turned on.

On the other hand, if the type of the sheet P is coated paper, the dryer controller 503 determines whether or not the basis weight (or thickness) is equal to or less than the threshold value (i.e., thin paper or not) (S23). If the basis weight (or thickness) of the sheet P is more than the threshold value (i.e., the sheet P is not thin paper), the predetermined condition is not satisfied, and therefore the process is ended. As a result, the first dryer 60 is not turned on.

On the other hand, if the basis weight (or thickness) of the sheet P is equal to or less than the threshold value (i.e., the sheet P is thin paper), the predetermined condition is satisfied, and thus the dryer controller 503 turns on the first dryer 60 to dry the sheet P (S24). Such control can provide the effects equivalent to those by the first embodiment, and referring to the table is unnecessary, thereby simplifying the process.

Figure 12:
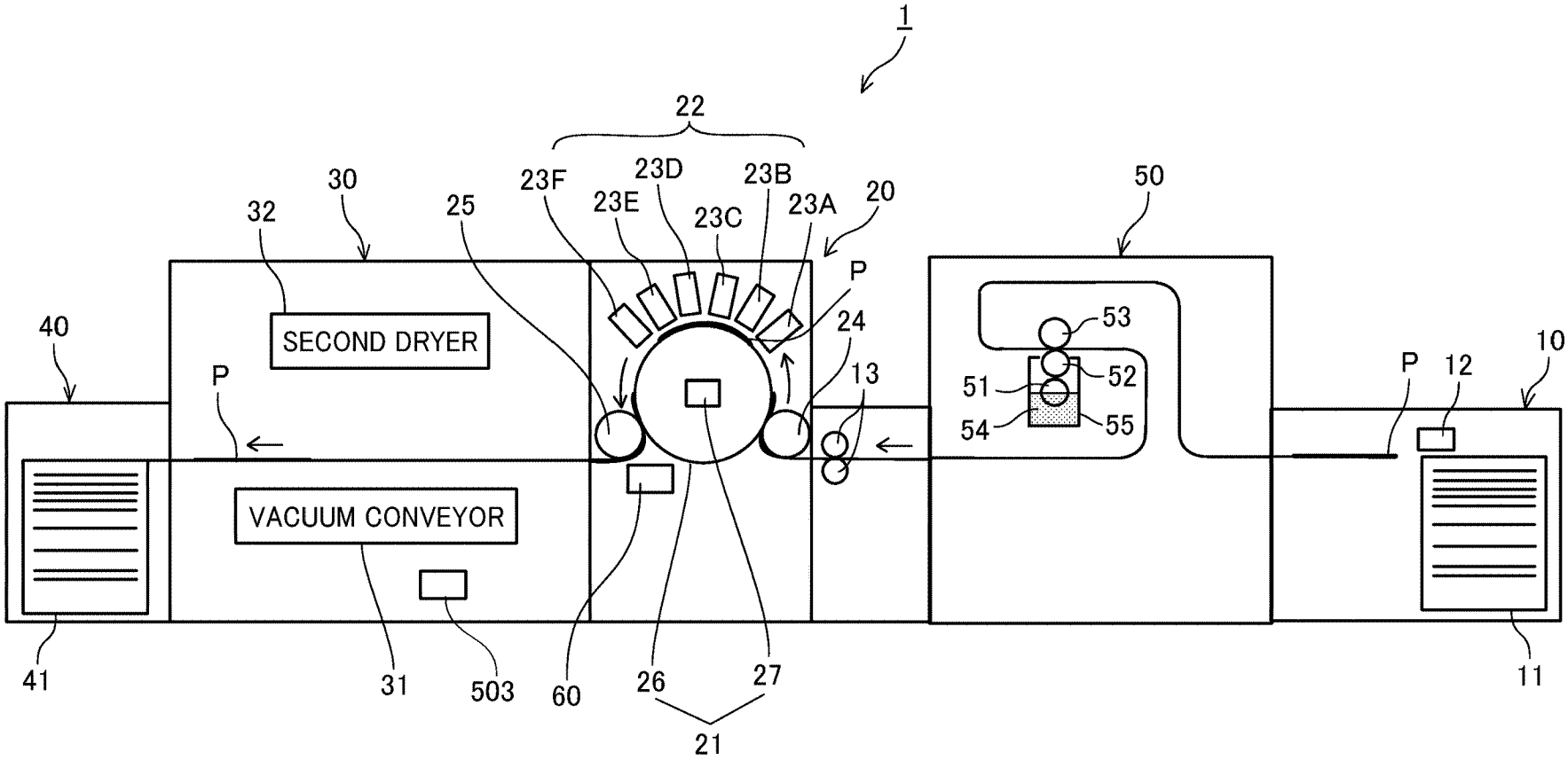
FIG. 12 is a schematic view of a printer as a liquid discharge apparatus according to a fourth embodiment of the present disclosure.

Next, a fourth embodiment of the present disclosure is described with reference to FIG. 12. FIG. 12 is a schematic side view of an example of a printer 1 as a liquid discharge apparatus according to the fourth embodiment. In addition to the configuration of the printer 1 according to the first embodiment, the printer 1 includes a pretreatment device 50 to perform pretreatment on the sheet P. The pretreatment device 50 is disposed upstream from the printing device 20 in the conveyance path in which the sheet P is conveyed.

The pretreatment device 50 includes a treatment liquid container 55 to store a treatment liquid 54, a draw-up roller 51 to draw the treatment liquid 54, an application roller 52 to apply (provide) the treatment liquid 54 to the sheet P, and a counter roller 53 opposed to the application roller 52 via the sheet P. For example, the treatment liquid 54 reacts with a liquid to reduce bleeding of the liquid.

After the application roller 52 applies the treatment liquid 54 to the lower surface of the sheet P, the sheet P is turned upside down and conveyed to the registration roller pair 13. The sheet P that has passed through the registration roller pair 13 is conveyed while the surface to which the treatment liquid 54 has been applied faces discharge units 23, and the discharge units 23 applies the liquid to the surface of the sheet P.

Figures 13, 14:
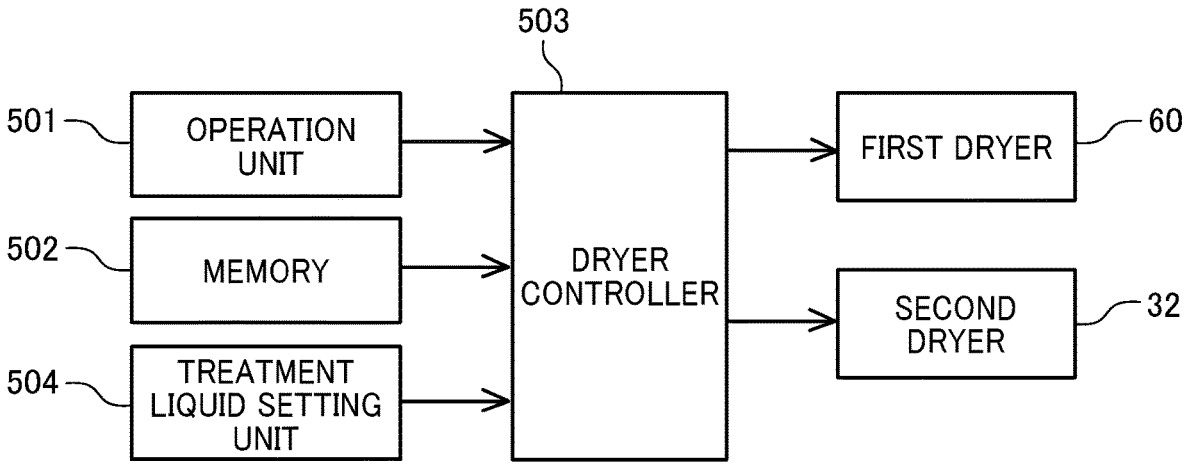
FIG. 13 is a block diagram of a portion related to the control of the drying operation by the first dryer and the second dryer according to the fourth embodiment.
FIG. 14 is a table stored in the memory illustrated in FIG. 13.

Next, control of the drying operation by the first dryer 60 and the second dryer 32 is described below with reference to FIGS. 13 and 14. FIG. 13 is a block diagram of the control system of the printer (liquid discharge apparatus) 1. FIG. 14 is a table stored in the memory 502 illustrated in FIG. 13. Similarly to the second embodiment described above, in the present embodiment, an operator inputs the type number of the sheet P, using the operation unit 501.

A treatment liquid setting unit 504 sets whether the pretreatment device 50 applies the treatment liquid 54 or not as application information. In the present embodiment, the application information set by the treatment liquid setting unit 504 is transmitted to the dryer controller 503 as the sheet data regarding the sheet P.

The memory 502 stores a table as illustrated in FIG. 14 in which the sheet data, such as whether the treatment liquid 54 is applied to the sheet P or not, the type of the sheet P, the basis weight or thickness of the sheet P, and the ON/OFF data of the first dryer 60 and the second dryer 32, are tabulated. The memory 502 also stores the table in which the type number of the sheet P is associated with the type of the sheet P (e.g., coated paper and plain paper) and the basis weight (or thickness).

The dryer controller 503 turns on and off the first dryer 60 and the second dryer 32 based on the type number of the sheet P input from the operation unit 501 and whether the treatment liquid 54 is applied or not, which is provided from the treatment liquid setting unit 504. The dryer controller 503 turns on the first dryer 60 to dry (heat) the sheet P by the first dryer 60 when the sheet data satisfies a predetermined condition, that is, when the treatment liquid 54 is not applied, the sheet P is the coated paper, and the basis weight is low (i.e., the thickness is thin). The dryer controller 503 turns on the second dryer 32 regardless of the type of the sheet P, and the basis weight or thickness of the sheet P during printing.

The application of the treatment liquid 54 correlates with the ink flow. When the treatment liquid 54 is applied in a normal amount, the treatment liquid 54 prevents the pigment of the ink from flowing. Since the cost of printed matter increases when the treatment liquid 54 is applied, it is preferable to select whether or not the treatment liquid 54 is applied. When the treatment liquid 54 is not applied, the effect of preventing the pigment of the ink from flowing due to the treatment liquid 54 is not obtained. Therefore, the first dryer 60 dries the sheet P only when the sheet P is thin coated paper on which image unevenness is likely to occur.

Figure 15:
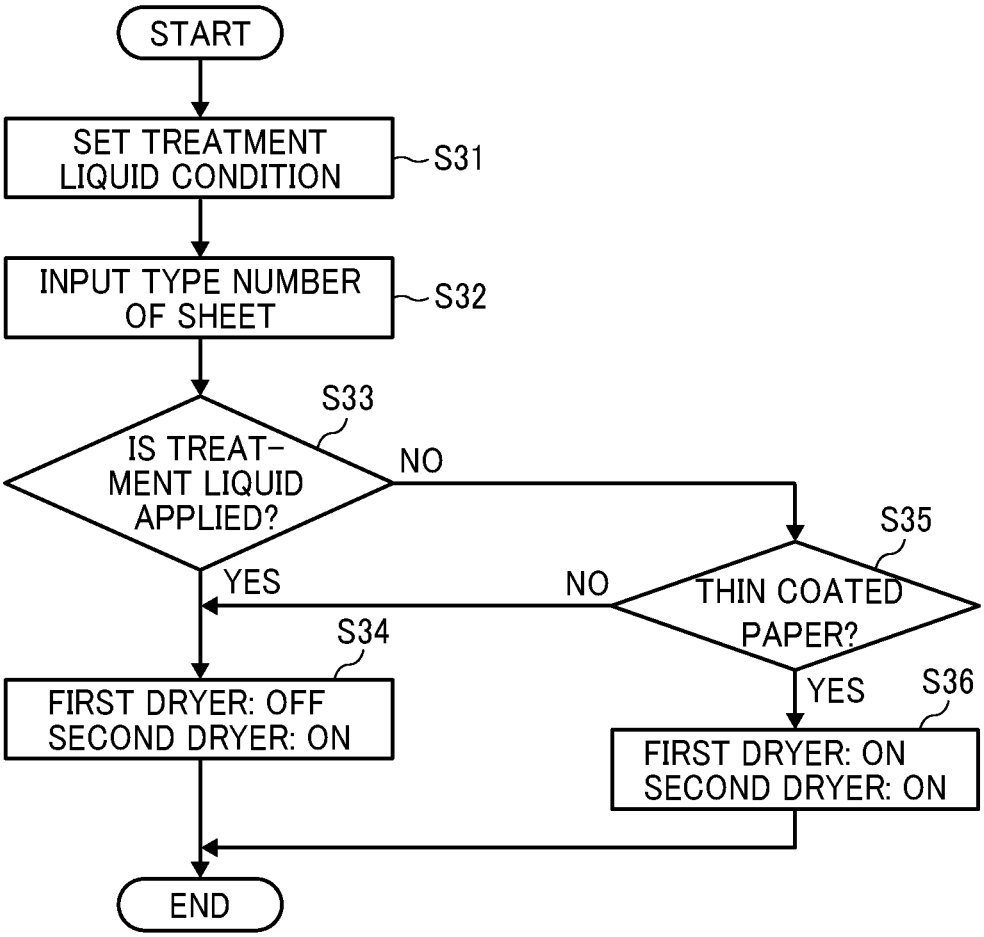
FIG. 15 is a flowchart illustrating the control of the drying operation according to the fourth embodiment.

A description is given of control of the drying operation according to the present embodiment, with reference to a flowchart in FIG. 15. The treatment liquid setting unit 504 sets whether the treatment liquid 54 is applied or not as the application information. The application information set by the treatment liquid setting unit 504 is transmitted to the dryer controller 503 as the sheet data (S31).

Then, an operator inputs the type number of the sheet P by the operation unit 501 (S32). The dryer controller 503 determines whether the treatment liquid 54 is applied or not (S33). When the treatment liquid 54 is applied, the predetermined condition that the treatment liquid 54 is not applied is not satisfied. Accordingly, the dryer controller 503 turns off the first dryer 60 not to dry the sheet P and turns on the second dryer 32 to dry the sheet P (S34).

On the other hand, when the treatment liquid is not applied, the dryer controller 503 refers to the table stored in the memory 502 and determines whether the sheet P corresponding to the type number is thin coated paper or not (S35). When the sheet P is thin coated paper, the predetermined condition that the treatment liquid 54 is not applied, and the sheet P is coated paper and thin paper is satisfied. Accordingly, the dryer controller 503 turns on the first dryer 60 to dry the sheet P and turns on the second dryer 32 to dry the sheet P (S36).

On the other hand, when the sheet P is not thin coated paper, the predetermined condition that the sheet P is coated paper and thin paper is not satisfied. Accordingly, the process proceeds to step S34, and the dryer controller 503 turns off the first dryer 60 not to dry the sheet P and turns on the second dryer 32 to dry the sheet P.

As described above, when color unevenness due to the influence of the heating unevenness does not occur, the dryer controller 503 turns off the first dryer 60 not to dry the sheet P, thereby reducing the power consumption of the printer (liquid discharge apparatus) 1.

Figure 16:
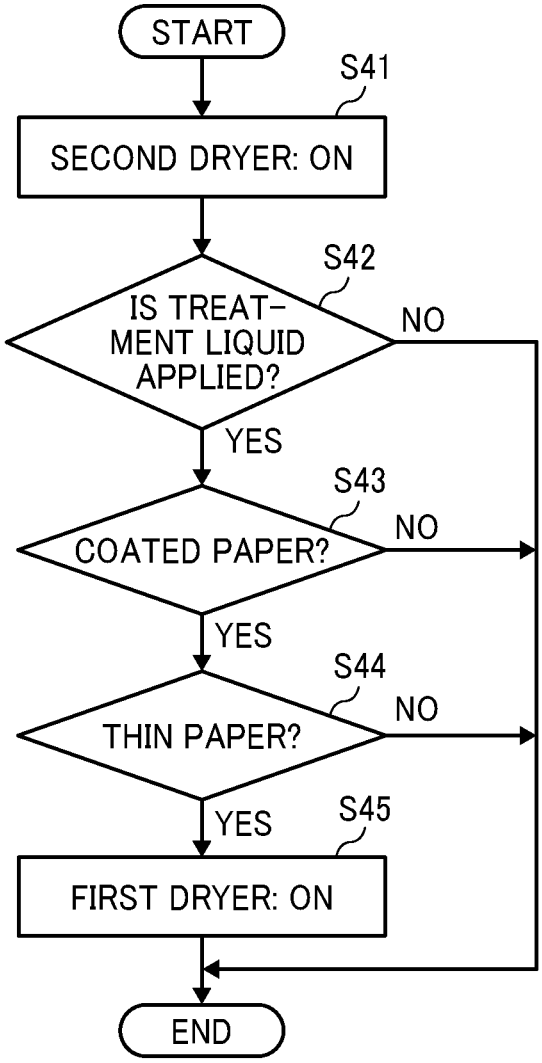
FIG. 16 is a flowchart illustrating the control of the drying operation according to a fifth embodiment of the present disclosure.

Next, a fifth embodiment of the present disclosure is described with reference to FIG. 16. FIG. 16 is a flowchart illustrating control of the drying operation according to the fifth embodiment. In the present embodiment, the tables are not provided in the memory 502 described in the fourth embodiment. The sheet data regarding the sheet P, such as the type and the basis weight (or thickness) of the sheet P input from the operation unit 501 and whether the treatment liquid 54 is applied or not provided from the treatment liquid setting unit 504, is temporarily stored in the buffer or the like.

Then, the dryer controller 503 turns on the second dryer 32 to dry (heat) the sheet P (S41). That is, as described in the fourth embodiments, the second dryer 32 is turned on regardless of the sheet data. Therefore, in the present embodiment, turning on and off the second dryer 32 is not associated with the sheet data regarding the sheet P.

Next, the dryer controller 503 determines whether the treatment liquid 54 is applied or not (S42). When the treatment liquid 54 is applied, the predetermined condition is not satisfied, and therefore the process is ended. As a result, the first dryer 60 is not turned on.

Next, the dryer controller 503 determines whether the type of the sheet P input from the operation unit 501 is coated paper or not (S43). If the type of the sheet P is not coated paper, that is, if the sheet P is plain paper, the predetermined condition is not satisfied, and therefore the process is ended. As a result, the first dryer 60 is not turned on.

On the other hand, if the type of the sheet P is coated paper, the dryer controller 503 determines whether the basis weight (or thickness) is equal to or less than the threshold value (i.e., thin paper or not) (S44). If the basis weight (or thickness) of the sheet P is more than the threshold value (i.e., the sheet P is not thin paper), the predetermined condition is not satisfied, and therefore the process is ended. As a result, the first dryer 60 is not turned on.

On the other hand, if the basis weight (or thickness) of the sheet P is equal to or less than the threshold value (i.e., the sheet P is thin paper), the predetermined condition is satisfied, and thus the dryer controller 503 turns on the first dryer 60 to dry the sheet P (S45). Such control can provide the effects equivalent to those by the fourth embodiment, and referring to the table is unnecessary, thereby simplifying the process.

A sixth embodiment according to the present disclosure is described with reference to FIG. 17. FIG. 17 is a table stored in the memory 502 according to the sixth embodiment. In the present embodiment, the treatment liquid setting unit 504 sets whether the pretreatment device 50 applies the treatment liquid 54 or not, and the amount of the treatment liquid 54 when the treatment liquid 54 is applied as application information. The application information set by the treatment liquid setting unit 504 is transmitted to the dryer controller 503 as the sheet data.

The memory 502 stores a table as illustrated in FIG. 17 in which the sheet data, such as whether the treatment liquid 54 is applied to the sheet P or not, the application amount of the treatment liquid 54 to be applied to the sheet P, the type of the sheet P, the basis weight or thickness of the sheet P, and the ON/OFF data of the first dryer 60 and the second dryer 32, are tabulated. The application amount is classified in four levels: very small amount, small amount, normal amount, and large amount. The ON/OFF data of the first dryer 60 includes duty cycle when the first dryer 60 is turned on or heats the sheet P (i.e., ON duty or heating duty). The memory 502 also stores the table in which the type number of the sheet P is associated with the type of the sheet P (e.g., coated paper and plain paper) and the basis weight (or thickness).

The application amount of very small amount is a first amount, the application amount of small amount is a second amount larger than the first amount, the application amount of normal amount is a third amount larger than the second amount, and the application amount of large amount is a fourth amount larger than the third amount.

In other words, in the present embodiment, the pretreatment device 50 has five modes to apply the treatment liquid 54, which include four patterns of the application amount (i.e., very small amount, small amount, normal amount, and large amount), and another pattern in which the treatment liquid 54 is not applied. An operator can select the application amount among the five modes, using the operation unit 501. As illustrated in the table in FIG. 17, in addition to the conditions of the above-described embodiments, the first dryer 60 is turned on and off based on the ON duty (heating duty) in consideration of the application amount of the treatment liquid 54.

The dryer controller 503 turns on and off the first dryer 60 and the second dryer 32 based on the type number of the sheet P input from the operation unit 501, whether the treatment liquid 54 is applied or not, and the application amount, which is provided from the treatment liquid setting unit 504. When the first dryer 60 is turned on, the dryer controller 503 controls (changes) the ON duty of the first dryer 60 based on the application information on the application amount of the treatment liquid 54 provided from the treatment liquid setting unit 504.

The dryer controller 503 turns on the first dryer 60 to dry (heat) the sheet P by the first dryer 60 when the sheet data satisfies the predetermined condition, that is, in the present embodiment, when the treatment liquid 54 is not applied or the application amount of the treatment liquid 54 applied to the sheet P is very small amount or small amount, and when the sheet P is the coated paper and the basis weight is low (i.e., the thickness is thin). The dryer controller 503 turns on the second dryer 32 regardless of the type of the sheet P, and the basis weight or thickness of the sheet P during printing.

When the sheet data satisfies the predetermined condition and the first dryer 60 is turned on, the dryer controller 503 controls the ON duty of the first dryer 60 based on the application amount of the treatment liquid 54. That is, even when the treatment liquid 54 is applied to thin coated paper, if the application amount of the treatment liquid 54 is equal to or less than a predetermined amount, in the present embodiment, when the application amount is very small amount or small amount, the first dryer 60 dries the sheet P because the effect of preventing the pigment of the ink from flowing due to the treatment liquid 54 is insufficient. Since the effect of preventing the pigment of the ink from flowing depends on the application amount, the ON duty in the case of very small amount is relatively higher than the ON duty in the case of small amount.

Figure 18:
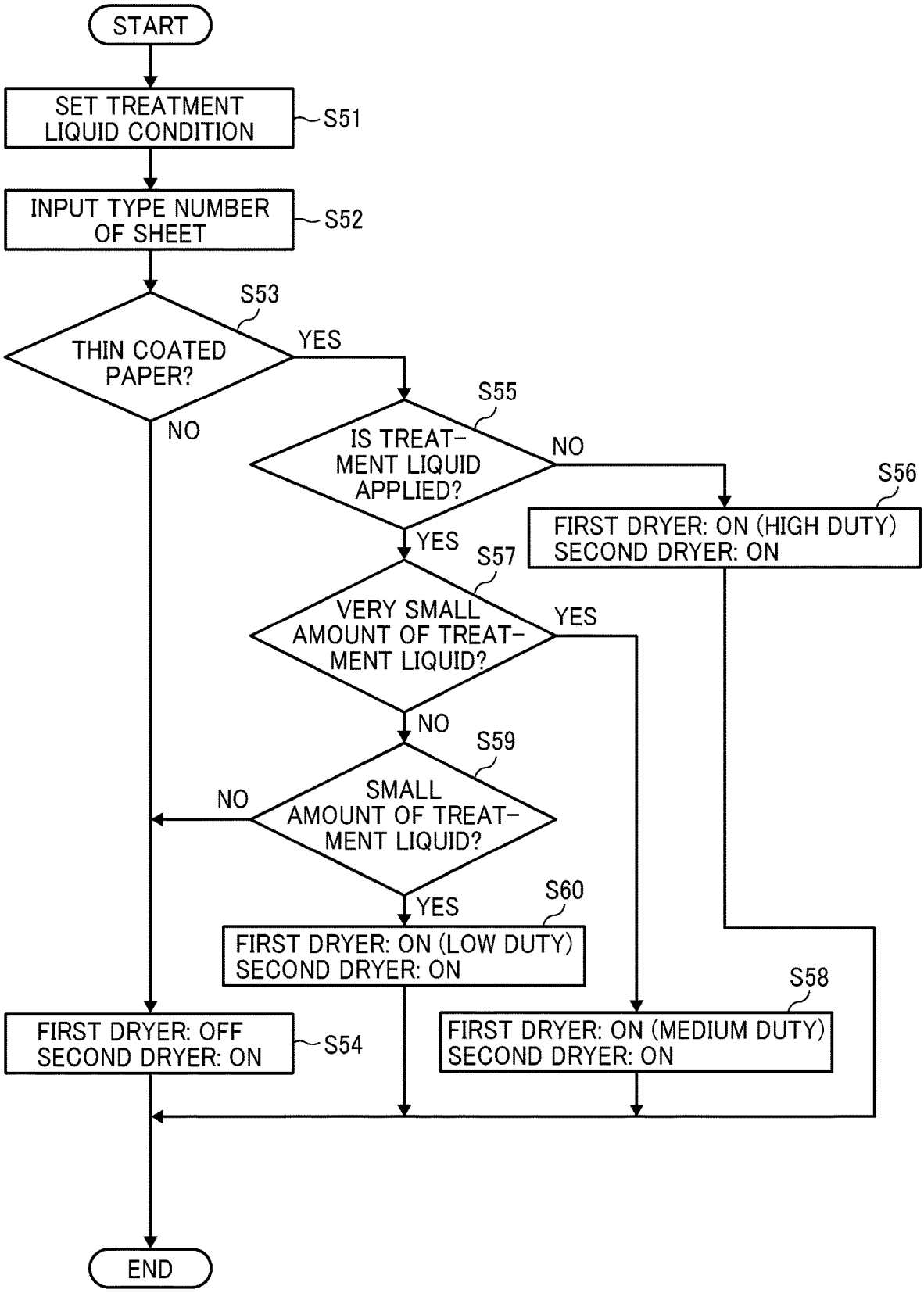
FIG. 18 is a flowchart illustrating the control of the drying operation according to the sixth embodiment.

A description is given of control of the drying operation according to the present embodiment, with reference to a flowchart in FIG. 18. The treatment liquid setting unit 504 sets whether or not the treatment liquid 54 is applied and the application amount as the application information. The application information set by the treatment liquid setting unit 504 is transmitted to the dryer controller 503 as the sheet data (S51).

As an operator inputs the type number of the sheet P by the operation unit 501 (S52), the dryer controller 503 refers to the table stored in the memory 502 and determines whether the sheet P corresponding to the type number is coated paper or not (S53). When the type of the sheet P is plain paper, not thin coated paper, the predetermined condition that the sheet P is coated paper is not satisfied. Accordingly, the dryer controller 503 turns off the first dryer 60 not to dry the sheet P and turns on the second dryer 32 to dry the sheet P (S54).

On the other hand, when the sheet P is thin coated paper, the dryer controller 503 determines whether the treatment liquid 54 is applied or not (S55). When the treatment liquid 54 is not applied, the predetermined condition that the treatment liquid 54 is not applied, and the sheet P is coated paper and thin paper is satisfied. Accordingly, the dryer controller 503 turns on the first dryer 60 with the high ON duty to dry the sheet P and turns on the second dryer 32 to dry the sheet P (S56).

On the other hand, if the treatment liquid 54 is applied, the dryer controller 503 determines whether or not the application amount is very small amount (S57). When the application amount of the treatment liquid 54 is very small amount, the predetermined condition that the treatment liquid 54 is applied, the application amount is very small amount, and the sheet P is coated paper and thin paper is satisfied. Accordingly, the dryer controller 503 turns on the first dryer 60 with the medium ON duty to dry the sheet P and turns on the second dryer 32 to dry the sheet P (S58).

On the other hand, if the application amount of the treatment liquid 54 is not very small amount, the dryer controller 503 determines whether or not the application amount is small amount (S59). When the application amount of the treatment liquid 54 is small amount, the predetermined condition that the treatment liquid 54 is applied, the application amount is small amount, and the sheet P is coated paper and thin paper is satisfied. Accordingly, the dryer controller 503 turns on the first dryer 60 with the low ON duty to dry the sheet P and turns on the second dryer 32 to dry the sheet P (S60).

On the other hand, when the application amount of the treatment liquid 54 is not small amount, that is, when the application amount is normal amount or large amount, the sheet data does not satisfy the predetermined condition. Accordingly, the process proceeds to step S54, and the dryer controller 503 turns off the first dryer 60 not to dry the sheet P and turns on the second dryer 32 to dry the sheet P.

In the present embodiment, the input voltage applied to the first dryer (first heater) 60 is changed to switch the ON duty between high, medium, and low. The high input voltage corresponds to the high ON duty. Alternatively, the first dryer 60 is switched on and off at the same voltage to switch the ON duty between high, medium, and low. As the ON ratio of the first dryer 60 increases, the ON duty becomes higher.

As described above, when the normal or large amount of the treatment liquid 54 is applied, the treatment liquid 54 can prevent the pigment of the ink from flowing. When the very small or small amount of the treatment liquid 54 is applied, or the treatment liquid 54 is not applied, the first dryer 60 dries the sheet P in semi-dry state, thereby preventing the pigment of the ink from flowing. Thus, the first dryer 60 appropriately dries the sheet P. As a result, high image quality without color unevenness can be obtained.

Note that, in the present embodiment, the dryer controller 503 can determine whether the sheet P is thin coated paper or not after turning on the second dryer 32 without the table described above. In the case of thin coated paper, the dryer controller 503 sequentially determines whether the treatment liquid 54 is applied or not, and the application amount of the treatment liquid 54 to be applied to the sheet P. Then, the dryer controller 503 can turn on the first dryer 60 with the ON duty corresponding to when the treatment liquid 54 is not applied, when the application amount of the treatment liquid 54 to be applied to the sheet P is very small amount, and when the application amount is small amount.

Figure 19:
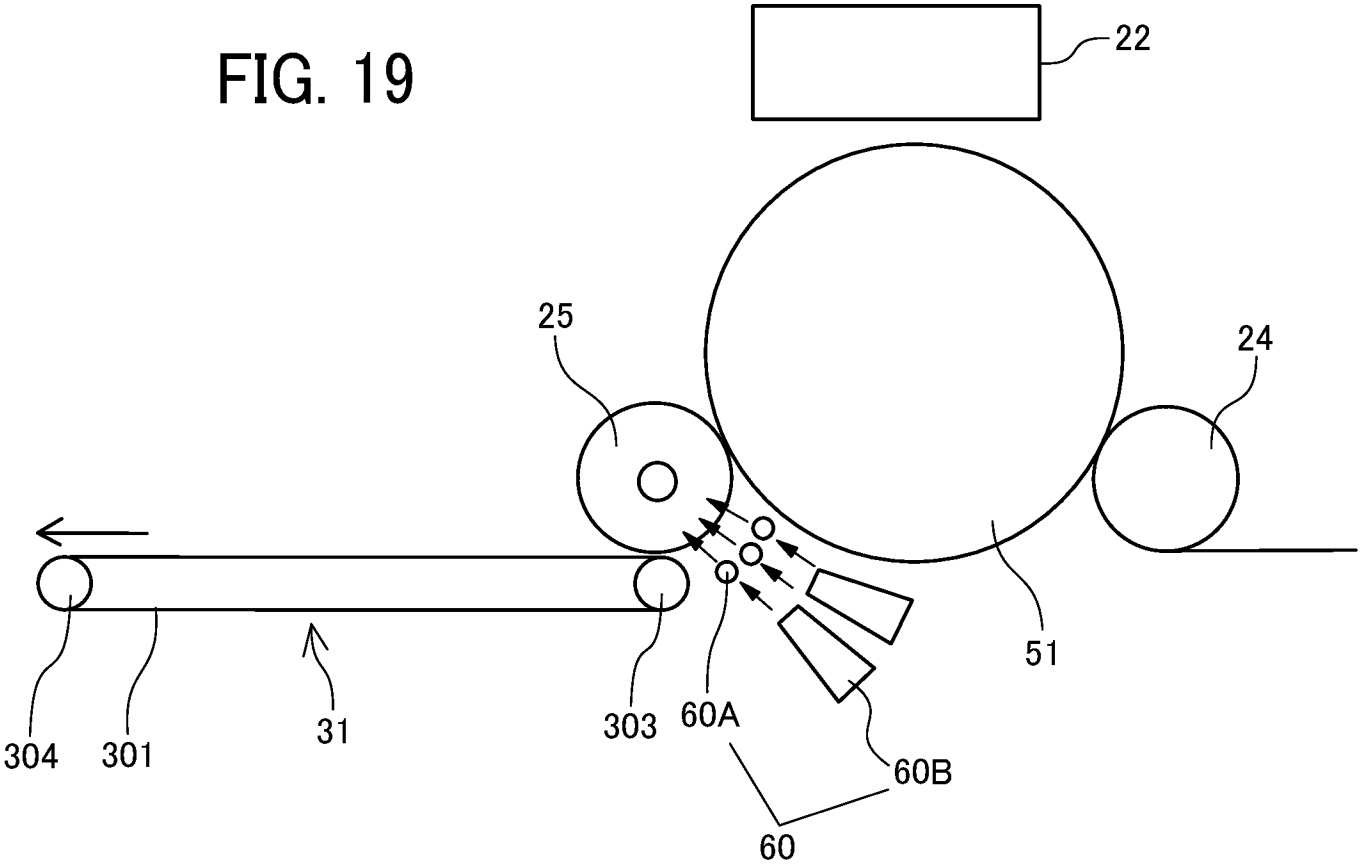
FIG. 19 is a partial view of a printer as a liquid discharge apparatus according to a seventh embodiment of the present disclosure.

Next, a seventh embodiment of the present disclosure is described with reference to FIG. 19. FIG. 19 is a partial view of a printer (liquid discharge apparatus) 1 according to the seventh embodiment. In the present embodiment, the first dryer 60 includes an IR heater 60A and a hot air blower 60B disposed opposite the transfer path of the transfer cylinder 25. The IR heater 60A heats and the hot air blower 60B blows hot air onto the surface of the sheet P opposite the surface to which the liquid has been applied. With this configuration, the amount of heat applied to the sheet P is larger than that in the first and second embodiments.

Figure 20:
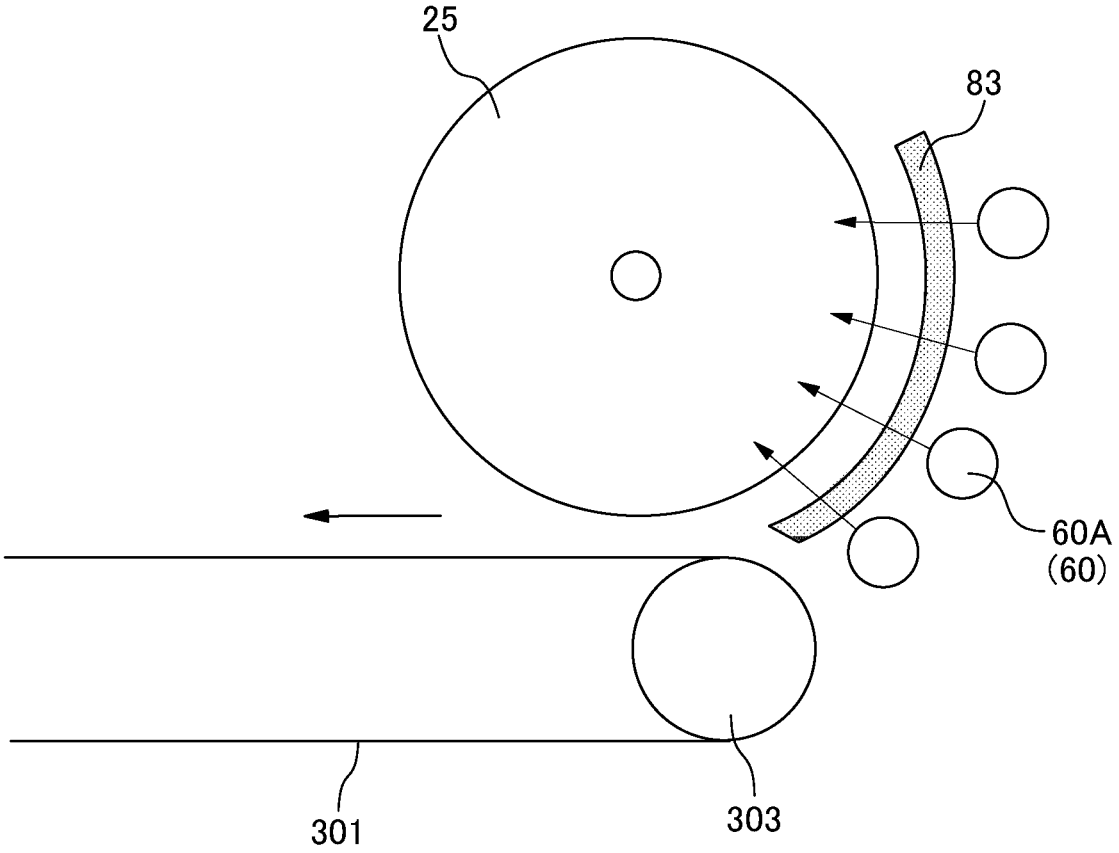
FIG. 20 is a partial view of a printer as a liquid discharge apparatus according to an eighth embodiment of the present disclosure.

Next, an eighth embodiment of the present disclosure is described with reference to FIG. 20. FIG. 20 is a partial view of a printer (liquid discharge apparatus) 1 according to the present embodiment. In the present embodiment, the first dryer 60 includes an IR heater 60A disposed opposite the transfer path of the transfer cylinder 25 and a guide plate 83 to guide the sheet P. The IR heater 60A heats the surface of the sheet P opposite the surface to which the liquid has been applied. The guide plate 83 is disposed between the transfer cylinder 25 and the IR heater 60A. With this configuration, the guide plate 83 prevents the sheet P from contacting the IR heater 60A when the sheet P is jammed.

Figure 21:
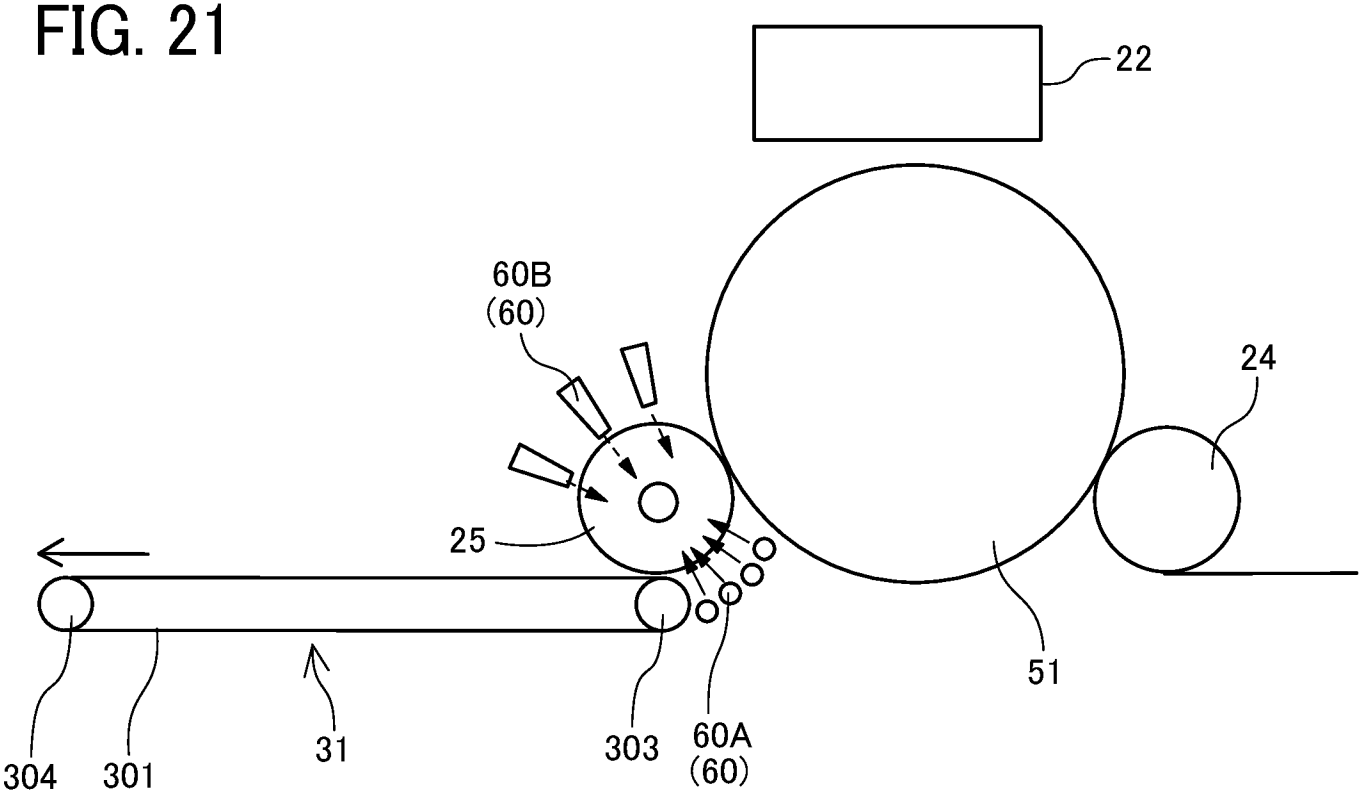
FIG. 21 is a partial view of a printer as a liquid discharge apparatus according to a ninth embodiment of the present disclosure.

Next, a ninth embodiment of the present disclosure is described with reference to FIG. 21. FIG. 21 is a partial view of a printer (liquid discharge apparatus) 1 according to the ninth embodiment. In the present embodiment, the first dryer 60 includes a hot air blower 60B disposed opposite the transfer path of the transfer cylinder 25. The hot air blower 60B blows hot air from the back side of the transfer cylinder 25 to the front surface of the sheet P to which the liquid has been applied.

In addition, the first dryer 60 includes an IR heater 60A disposed opposite the transfer path of the transfer cylinder 25. The IR heater heats the back surface of the sheet P opposite the front surface to which the liquid has been applied. With this configuration, the first dryer 60 can heat both the front surface and the back surface of the sheet P, thereby drying the sheet P efficiently. Further, the sheet P is preheated on the transfer path of the transfer cylinder 25 having a diameter smaller than that of the drum 26, thereby applying heat to the sheet P from both the front and back sides efficiently.

As described above, the transfer cylinder 25 is substantially hollow in the width direction of the sheet P held on the transfer cylinder 25. Therefore, the hot air blown from the hot air blower 60B can penetrate the inside of the transfer cylinder 25 and reaches the surface of the sheet P gripped by the gripper 82. By using the transfer cylinder 25 having the diameter smaller than that of the drum 26, the position where the hot air is blown across the transfer cylinder 25 can be disposed close to the position of the sheet P conveyed on the transfer path, thereby applying heat to the sheet P efficiently.

In the present embodiment, for example, a temperature of the hot air of the hot air blower 60B is 60° C. to 100° C., and the IR heater 60A uses a heat source having a wavelength of 2 to 3 μm.

Figure 22:
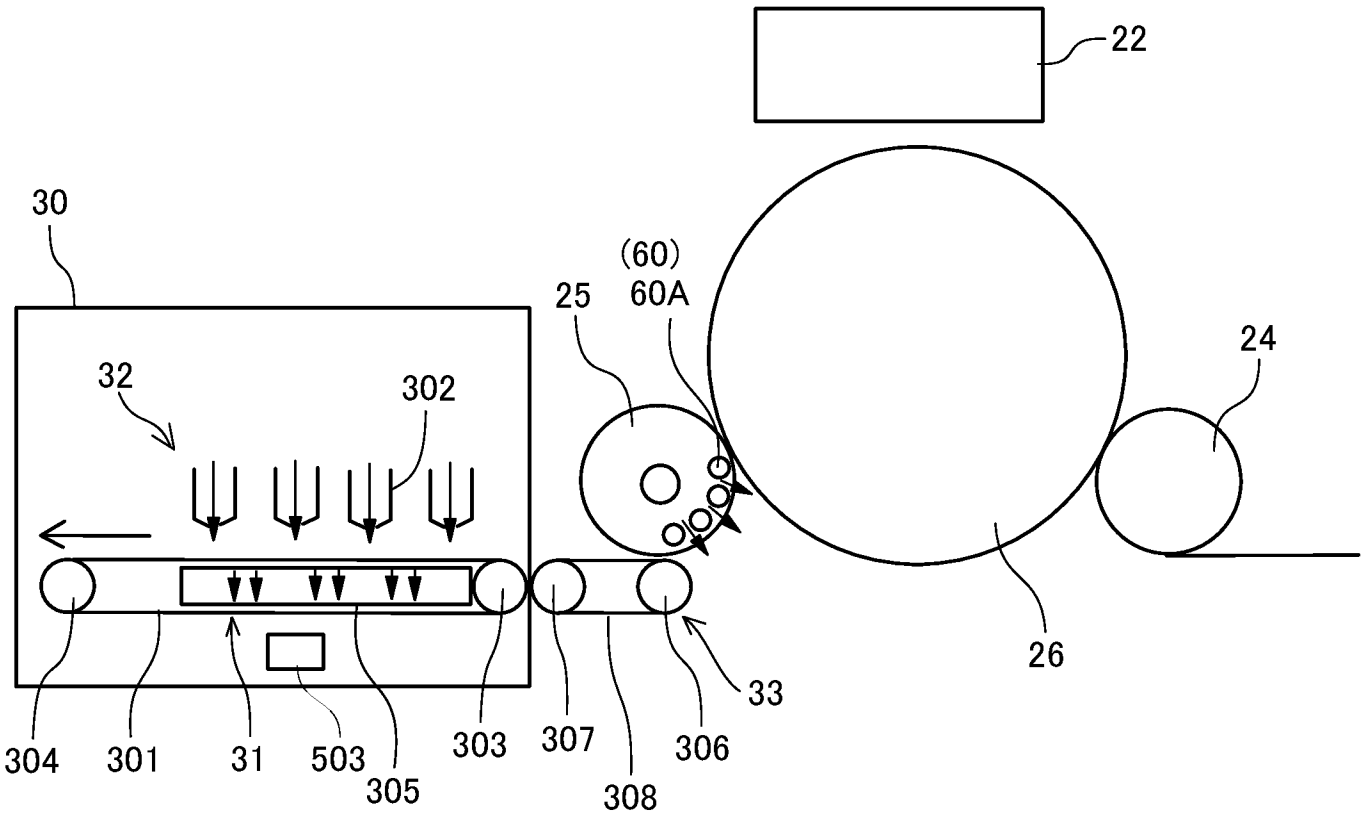
FIG. 22 is a partial view of a printer as a liquid discharge apparatus according to a tenth embodiment of the present disclosure.

Next, a tenth embodiment of the present disclosure is described with reference to FIG. 22. FIG. 22 is a partial view of a printer (liquid discharge apparatus) 1 according to the tenth embodiment. In the present embodiment, the drying device 30 includes a conveyor 33 to convey the sheet P. After passing through the first dryer 60, the sheet P is conveyed to the vacuum conveyor 31 by the conveyor 33. That is, in the present embodiment, the vacuum conveyance belt 301 of the vacuum conveyor 31 is arranged inside the housing of the drying device 30. The conveyor 33 is arranged between the transfer cylinder 25 and the vacuum conveyance belt 301 of the drying device 30.

The conveyor 33 includes a transfer belt 308 that receives the sheet P from the transfer cylinder 25 and transfers the sheet P to the vacuum conveyance belt 301. The transfer belt 308 is wound around a drive roller 306 and a driven roller 307, and is rotated by driving the drive roller 306. The transfer belt 308 can convey the sheet P while sucking or attracting the sheet P. The transfer belt 308 may have the same structure as the structure illustrated FIG. 5 or 6.

As described above, according to the present disclosure, power consumption can be reduced while abnormal images are prevented.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Any one of the above-described operations may be performed in various other ways, for example, in an order different from the one described above.

What is claimed is:

1. A heating device comprising:

a first heater configured to heat a sheet of paper to which a liquid has been applied;

a vacuum conveyor configured to convey the sheet that has passed through the first heater while sucking the sheet;

a second heater configured to heat the sheet being conveyed by the vacuum conveyor; and circuitry configured to cause the first heater to heat the sheet when sheet data regarding the sheet satisfies a predetermined condition, wherein the predetermined condition comprises the sheet being coated and the sheet having a thickness equal to or less than a threshold value, wherein the first heater heats the sheet before the sheet contacts the vacuum conveyor, wherein the circuitry is further configured to refrain from causing the first heater to heat the sheet when the sheet data regarding the sheet does not satisfy the predetermined condition, wherein the circuitry is further configured to cause the second heater to heat the sheet regardless of whether the sheet data regarding the sheet does not satisfy the predetermined condition, wherein the circuitry maintains a table that, in the event that a treatment liquid is not applied: selectively defines the first heater and the second heater as being on when the sheet is coated and thinner than a threshold amount, and selectively defines the first heater as being off and the second heater as being on when the sheet is coated and thicker than the threshold amount.

2. The heating device according to claim 1, wherein the sheet data includes a thickness of the sheet or basis weight of the sheet.

3. The heating device according to claim 1, wherein the sheet data includes a type of the sheet.

4. The heating device according to claim 1, wherein the sheet data includes information on whether the treatment liquid has been applied to the sheet or not.

5. The heating device according to claim 4, wherein the circuitry is configured to cause the first heater to change a heating duty based on an application amount of the treatment liquid.

6. The heating device according to claim 1, further comprising a conveyor configured to convey the sheet that has passed through the first heater to the vacuum conveyor.

7. The heating device according to claim 1, wherein the heating device is configured to dry sheets that have been marked by a printer.

8. A liquid discharge apparatus comprising:

a liquid discharge unit configured to discharge the liquid to the sheet; and the heating device according to claim 1.

9. The heating device according to claim 1, wherein:

the circuitry maintains a further table that selectively defines the first heater and the second heater as being on when the sheet has received a liquid treatment, is coated, and is thinner than a threshold amount, and selectively defines the first heater as being off and the second heater as being on for all other conditions.

10. The heating device according to claim 1, wherein:

the circuitry is configured to cause the first heater to heat the sheet before the sheet contacts the vacuum conveyor which has been heated by the second heater.

11. A drying device configured to dry a sheet of paper to which a liquid discharge unit discharges a liquid, the drying device comprising:

a first dryer configured to dry the sheet that has passed through the liquid discharge unit;

a vacuum conveyor configured to convey the sheet that has passed through the first dryer while sucking the sheet;

a second dryer configured to dry the sheet being conveyed by the vacuum conveyor; and circuitry configured to cause the first dryer to dry the sheet when sheet data regarding the sheet satisfies a predetermined condition, wherein the predetermined condition comprises the sheet being coated and the sheet having a thickness equal to or less than a threshold value, wherein the first dryer dries the sheet before the sheet contacts the vacuum conveyor, wherein the circuitry is further configured to refrain from causing the first dryer to dry the sheet when the sheet data regarding the sheet does not satisfy the predetermined condition, wherein the circuitry is further configured to cause the second dryer to dry the sheet regardless of whether the sheet data regarding the sheet does not satisfy the predetermined condition, wherein the circuitry maintains a table that, in the event that a treatment liquid is not applied: selectively defines the first dryer and the second dryer as being on when the sheet is coated and thinner than a threshold amount, and selectively defines the first dryer as being off and the second dryer as being on when the sheet is coated and thicker than the threshold amount.

12. A liquid discharge apparatus comprising:

a liquid discharge unit configured to discharge the liquid to the sheet; and the drying device according to claim 11.

* * * * *